United States Patent [19]

Cowan

[11] Patent Number: 4,842,444

[45] Date of Patent: Jun. 27, 1989

[54] METHOD FOR DISPLACING OXYGEN FROM A MINE

[75] Inventor: Philip B. Cowan, Littleton, Colo.

[73] Assignee: Tusco, Incorporated, Commerce City, Colo.

[21] Appl. No.: 106,460

[22] Filed: Oct. 9, 1987

[51] Int. Cl.[4] ..... E21F 5/00; E21F 17/00; E21F 17/16

[52] U.S. Cl. ..... 405/132; 405/303; 299/10; 299/12

[58] Field of Search ..... 166/369, 372, 902; 299/2, 10, 12; 405/132, 303

[56] References Cited

U.S. PATENT DOCUMENTS 3,118,363 1/1964 Burgess ..... 405/132 X 4,009,649 3/1977 Thimons et al. ..... 299/12 X 4,712,945 12/1987 Schrimpf ..... 405/132

FOREIGN PATENT DOCUMENTS 216508 12/1984 German Democratic Rep. ... 299/10

796461 1/1981 U.S.S.R. ..... 299/12

1041624 9/1983 U.S.S.R. ..... 405/132

*Primary Examiner*—Dennis L. Taylor

*Assistant Examiner*—John A. Ricci

*Attorney, Agent, or Firm*—Cushman, Darby & Cushman

[57] ABSTRACT

A method for preventing the formation of acidic mine water wherein inert gas in introduced into a mine cavity under positive pressure to displace oxygen contained therein. Upon detection of the displacement of substantially all of the oxygen from within the mine cavity, the mine cavity is permitted to flood and seal with water.

5 Claims, 3 Drawing Sheets

METHOD FOR DISPLACING OXYGEN FROM A MINE

FIELD OF THE INVENTION

The method according to the present invention relates to a method whereby an inert gas is introduced into a mine under positive pressure so that the oxygen contained within the mine cavity is displaced therefrom. More particularly, the method according to the present invention relates to the displacement of oxygen contained within a mine cavity so as to prevent the oxidation of pyrites which cause acid formation in seepage waters which collect in and pass out of the mine cavity.

BACKGROUND OF THE INVENTION

The problems associated with the known methods of sealing mine cavities are that oxidation of iron sulfides in the presence of water and atmospheric oxygen occurs. The chemical reactions can be summarized as follows:

Initiator Reaction $$2FeS_2+7O_2+2H_2O \rightarrow 2Fe^{+2}+4SO_4^{-2}+4H^+$$

Propagation Cycle $$4Fe^{+2}+O_2+4H^+ \rightarrow 4Fe^{+3}+2H_2O$$

$$FeS_2+14Fe^{+3}+8H_2O \rightarrow 15Fe^{+2}+2SO_4^{-2}+16H^+$$

$$Fe^{+3}+3H_2O \rightarrow Fe(OH)_3+H^+$$

In the initiator reaction, sulfur is oxidized to sulfate whereby hydrogen ions are generated and $Fe^{+2}$ (ferrous iron) is released into solution. This oxidation process may be accomplished by atmospheric oxygen or by the dissociation of pyrite in solution followed by oxidation by aqueous oxygen. In the initial stage of the cycle, natural alkalinity of the water is sufficient to prevent ferric iron from remaining in solution and insoluble ferric oxides are produced and precipitated, forming the characteristic yellow sediment. The formation of ferric oxides is accompanied by the release of hydrogen ions which cause the pH to decrease. When the pH has dropped enough to allow ferric iron to remain in solution, the second step of the propagation cycle begins. Ferric iron, a powerful oxidizing agent, assumes the primary role in the oxidation of pyrite. Ferric iron is reduced to ferrous iron to promote more sulfate and acidity and is then reoxidized to ferric iron.

Additionally, the powerful oxidizing action of ferric ions may be responsible for the release of other metals such as cadmium, copper, lead, zinc and manganese from their respective sulfide ores.

In addition to the effect of pH on the reaction process, microorganisms play a significant role in the formation of mine acid water drainage. Oxidation of $Fe^{+2}$ occurs at a very slow rate in the acid pH range typical of acidic mine water. The reaction would essentially cease once the pH was below five. However, bacterial catalysts can increase the rate of reaction by a factor greater than $10^6$. The acidophilic iron oxidizing bacterium *Thiobacillus ferrooxidans* is believed to be responsible for the catalyis. *T. ferrooxidans* derive metabolic energy from the oxidation of $Fe^{+2}$, a process that, in turn, creates the acid environment in which it thrives (pH −1 to 4.5). *T. ferrooxidans* is an aerobic bacteria although it can tolerate severe oxygen deprivation.

It has been shown that the rate determining step in the acid producing reactions noted above is the oxidation of ferrous iron. The presence of free oxygen is necessary in supporting the initiator reaction and also in supporting the existence of the *T. ferrooxidans* aerobic bacteria.

In order that the above-noted oxidation processes be eliminated, it has been proposed that the mine cavity be flooded. However, fear of contaminated, i.e., excessively acidic, waters exiting through uncontrolled seepage channels has caused this method to be discarded. Instead, a costly program of perpetual mine water treatment has been adopted.

SUMMARY OF THE INVENTION

The present method seeks to avoid the above-noted oxidation problems as well as to eliminate the costly perpetual mine water treatment programs. The present method proposes a process whereby a mine cavity is initially flooded with carbon dioxide or other inert gas so as to displace and remove free oxygen from the mine cavity. By maintaining a positive pressure on the mine, oxygen will be displaced in a direction consistent with its relationship with the displacing inert gas. That is, the oxygen will seek a level either higher or lower than the gas that is displacing it, depending on the relative weight of the displacing gas. Additionally, the oxygen will be displaced completely from the surrounding fissures and other interstitial spaces such that the acid formation ceases. Mine waters will continue to be removed and treated until the acid formation has been stopped. Thereafter, the mine will be allowed to flood and seal.

Other objects, features and characteristics of the present invention, as well as the methods and operation and functions of the related elements of the structure, and of the combination of parts and economies of manufacture, will become apparent upon consideration of the following description in the appended claims with references to the accompanying drawings, all of which form a part of this specification, wherein like reference numerals designate corresponding parts in the various figures.

DETAILED DESCRIPTION OF THE PREFERRED EMBODIMENT

The method according to the present invention uses either carbon dioxide gas, nitrogen gas, ammonia gas or other inert gas to displace oxygen trapped within mine cavity 10. By removing the source of free oxygen, the eventual formation of mine acid is prevented.

The method will now be described with reference to drawing FIGS. 1–6 wherein each drawing figure represents a particular orientation of the mine cavity, the condition of the mine for safe personnel entrance, and the particular inert gas being used.

Figure 1:
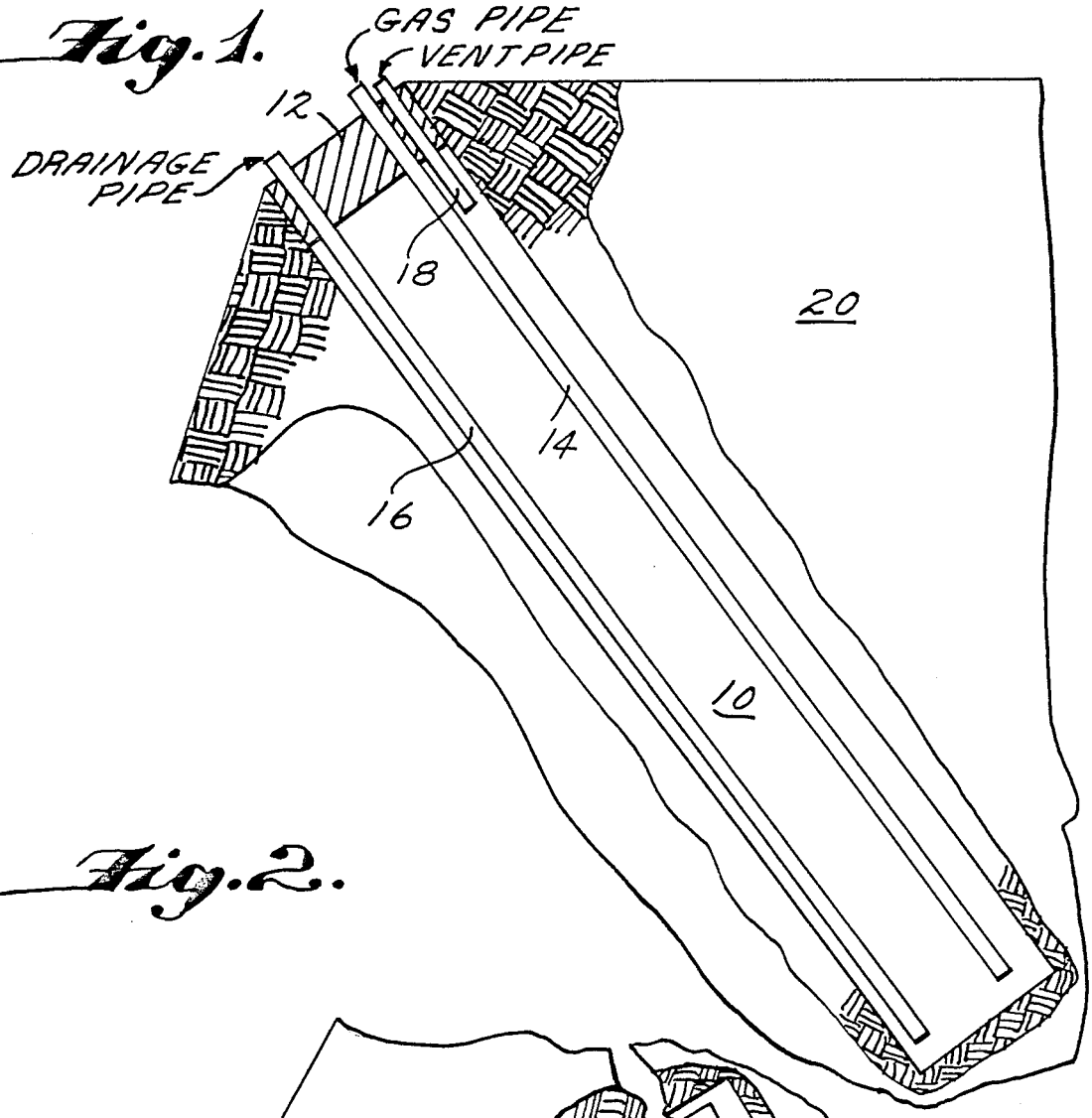
FIG. 1 is a schematic representation of an arrangement of apparatus with which to accomplish the present invention for a downwardly sloping mine cavity.

In FIG. 1, a downwardly sloping mine cavity 10 is shown within rock strata 20. The cavity is shown with a plug 12 in place with assorted piping extended therethrough into the mine cavity from the outside. In FIG. 1, the mine cavity 10 is suitable for personnel entrance such that the drainage pipe 16 and gas pipe 14 may be safely placed within the mine cavity either during the final retreat from the working face of the mine or by means of a separate working expedition within the mine cavity. Thus, the mine cavity is first equipped with the drainage and gas pipes 16 and 14, respectively. A plug 12 is then constructed in place to seal off at least all known entrances to the mine cavity. At the time the plug 12 is constructed, the drainage pipe, gas pipe, and vent pipe 18 are allowed to pass therethrough. Once a satisfactory seal has been constructed, carbon dioxide gas is introduced into the mine cavity through gas pipe 14. As the carbon dioxide is being pumped in, vent pipe 18 is monitored until no oxygen is detected in the venting gases. The vent pipe 18 is closed and a positive pressure placed in the mine cavity 10. Mine water is pumped to temporary treatment facilities through drainage pipe 16 and treated until the mine water is neutral and free from metals. When only neutral water is determined to be leaving the mine cavity through drainage pipe 16, the mine is allowed to fill with water and the sealing of the mine is completed.

If it is desired to monitor the mine after flooding, for environmental protection purposes, the drainage pipe 16 may be left in place so that, from time to time, samples may be collected and evaluated.

In the configuration of the mine cavity 10 with respect to rock strata 20 shown in FIG. 1, i.e., that the mine cavity is downwardly sloping with respect to the entrance, carbon dioxide is utilized as the inert gas, as it is heavier than air and will displace the air that contains oxygen upwards towards the entrance of the mine cavity and hence toward vent pipe 18.

Figure 2:
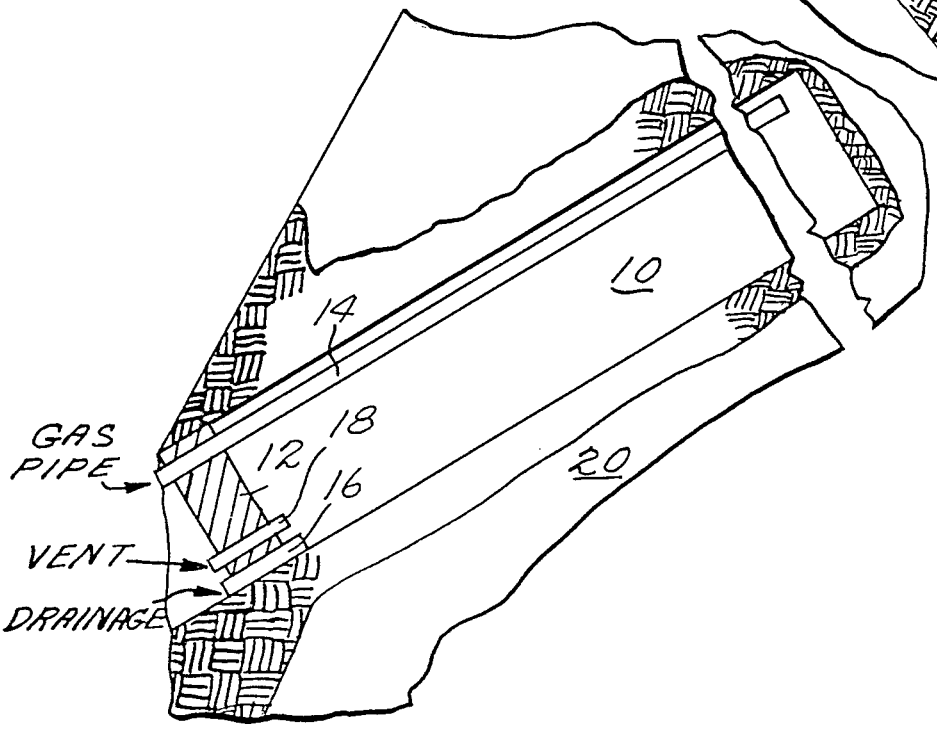
FIG. 2 is a schematic representation of apparatus with which to accomplish the present method for an upwardly sloping mine cavity.

FIG. 2 illustrates a mine cavity and rock strata configuration wherein the mine cavity is upwardly sloping, i.e., upward with respect to the entrance. In the same manner as that noted for FIG. 1, a gas pipe 14 is initially placed within the mine at any convenient time providing its placement can be safely accomplished. A plug 12 is placed over the mine cavity entrance with the gas pipe 14, vent pipe 18, and drainage pipe 16 allowed to extend therethrough. Nitrogen gas is introduced through gas pipe 14 and vent pipe 18 is monitored until no oxygen is detected exiting the mine cavity 10. The vent pipe is sealed and a positive pressure is placed on the mine cavity 10. Residual mine water is removed through drainage pipe 16 and processed at temporary treatment facilities until it is neutral and free from metals. When only neutral water is detected exiting the mine cavity through drainage pipe 16, the mine is then permitted to fill with water and plug 12 is made permanent. In this configuration, with an upwardly sloping mine cavity 10, nitrogen is used as the inert gas because it is lighter than air and will displace the air downwards towards vent pipe 18. Again, drainage pipe 16 may remain in place so that, from time to time, water within the mine cavity can be sampled and checked for neutrality.

Figure 3:
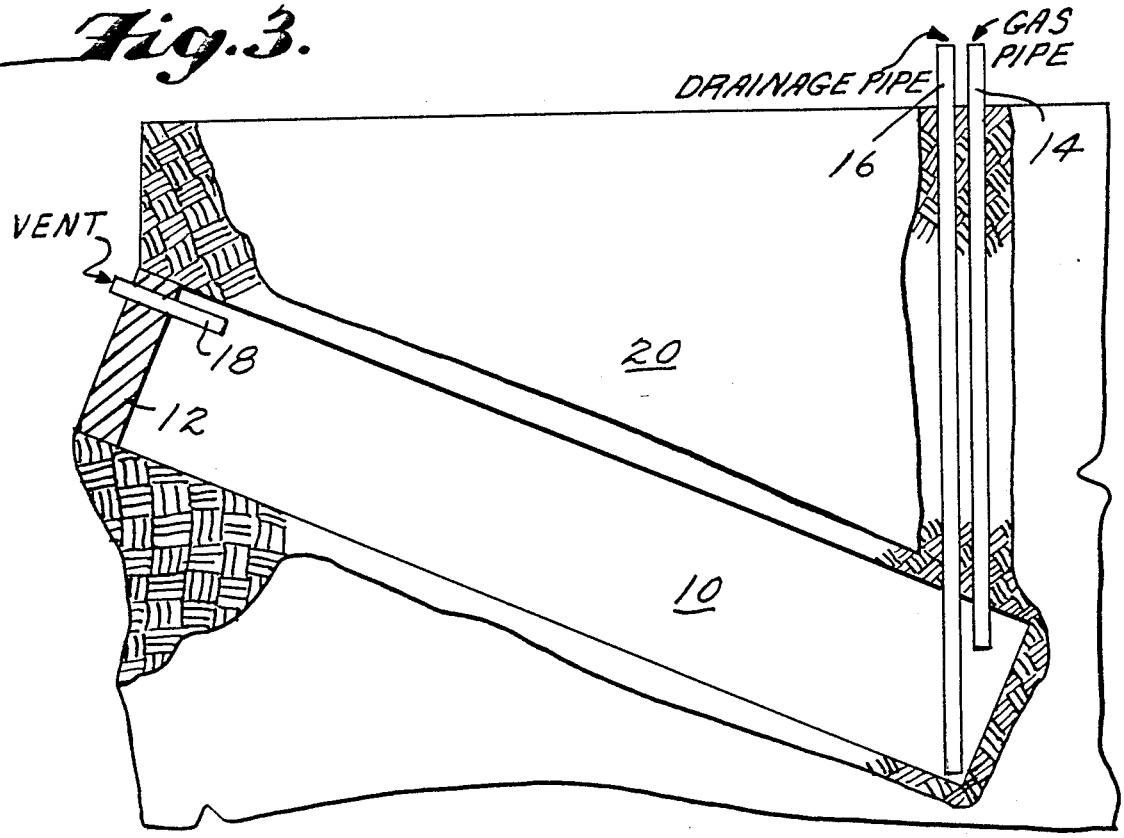
FIG. 3 is similar to FIG. 1 except that it is desirous that the mine cavity not be entered for purposes of apparatus placement.

FIG. 3 illustrates a mine cavity similar to that shown in FIG. 1, except that the mining cavity has been determined unsafe for entrance by mining personnel. In this case, it becomes impractical to lay drainage and gas pipes 16 and 14, respectively, within the mine cavity itself. As such, these pipes may be drilled into place from a location remote from the mine entrance, the only requirement being that the drainage pipe 16 intersect the mine cavity at a location where collection of residual mine water is possible. Similarly, gas pipe 14 must be drilled into a location such that complete displacement of the oxygen is possible when the mine cavity is charged with carbon dioxide. Since carbon dioxide is used as the inert gas, the method of execution is similar to that described in conjunction with FIG. 1. A plug 12 is placed over the mine cavity entrance with vent pipe 18 being allowed to pass therethrough. Drainage and gas pipes are drilled into place from a remote location such that they intersect the mine cavity as noted above. The mine is charged with carbon dioxide gas until the venting gases through vent pipe 18 no longer contain oxygen. When the displacement of the oxygen is completed, vent pipe 18 is sealed and a positive charge of carbon dioxide is placed within mine cavity 10. Residual mine water is then pumped out of drainage pipe 16 and thereafter processed and monitored until free from metals. When only neutral water is detected exiting the drainage pipe 16, the mine is sealed and permitted to fill with water. Again, drainage pipe 16 may be left in place so that, from time to time, water within the mine cavity may be sampled for neutrality.

Figure 4:
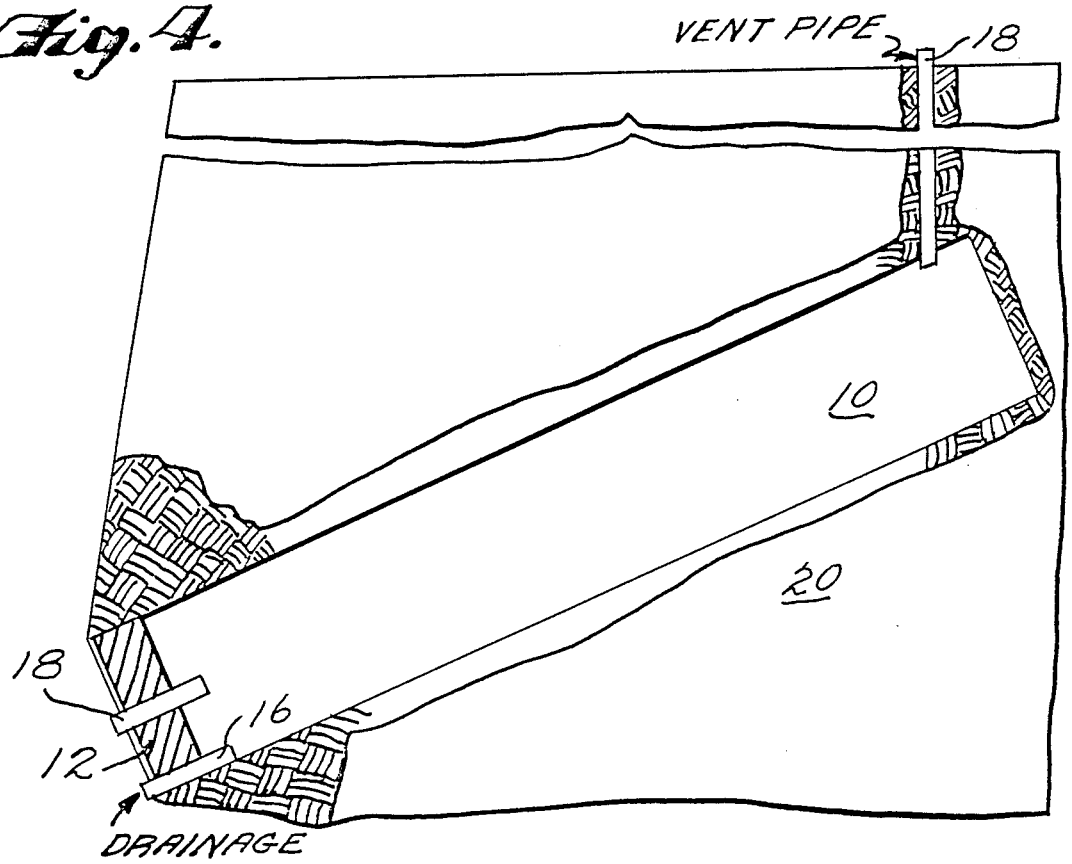
FIG. 4 is similar to FIG. 2 except that it is desirous not to enter the mine cavity for purposes of apparatus placement.

FIG. 4 is an illustration of an upwardly sloping mine cavity wherein it is not desirable to have personnel enter the mine cavity to place piping apparatus. In this illustration, a single vent pipe 18 is drilled to a location intersecting the rearward and upwardmost section of the mine cavity. The mine cavity entrance is sealed with a plug 12 allowing gas pipe 14 and drainage pipe 16 to pass therethrough. Again, carbon dioxide is introduced, only this time at the mine plug location and venting is performed via the drilled vent pipe 18. All other conditions and circumstances are the same as those described in relation to FIG. 2 above.

Figure 5:
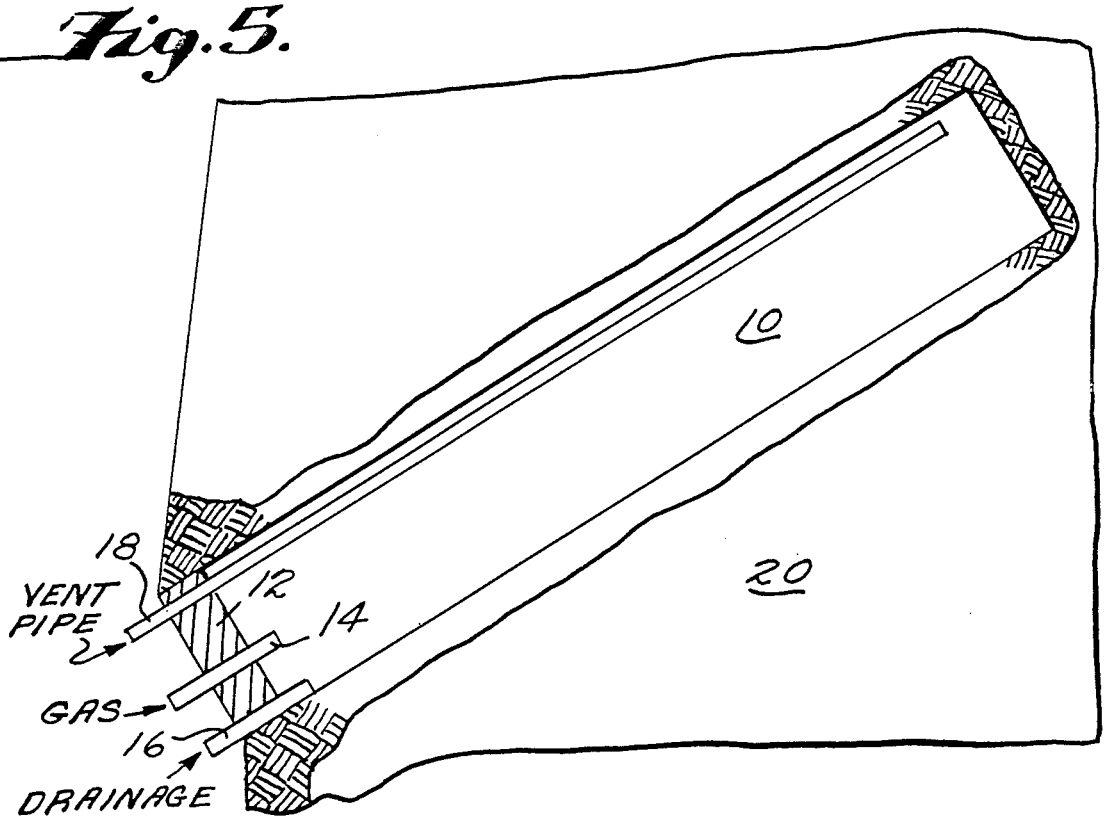
FIG. 5 is a schematic representation of apparatus with which to accomplish the present method wherein carbon dioxide is used to flood an upwardly sloping mine cavity.

FIG. 5 is another illustration of an upwardly sloping mine cavity 10; however, in this instance, a single vent pipe 18 is placed within the mine cavity from the entrance location. As such, venting can again be performed from an upper and rearwardmost location in the mine cavity. All other conditions are identical to those disclosed in relation to FIG. 4 above.

Figure 6:
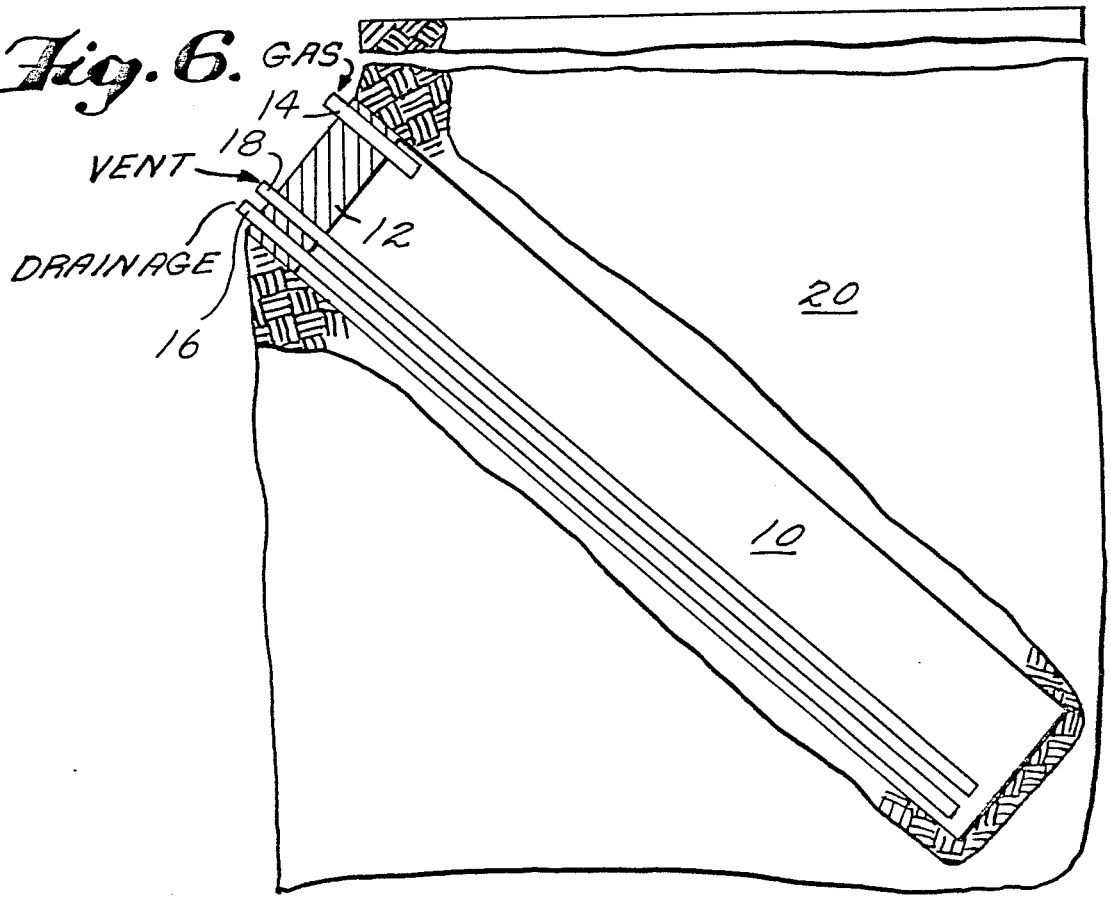
FIG. 6 is a schematic representation of apparatus with which to accomplish the present invention wherein nitrogen gas is used to flood a downwardly sloping mine cavity.

FIG. 6 is an illustration of a downwardly sloping mine cavity wherein the placement of vent pipe and drainage pipe is permissible within the mine cavity from the mine entrance. In this manner, vent pipe 18 and drainage pipe 16 are placed so that they intersect a lower and rearwardmost section of mine cavity 10. Nitrogen gas is introduced through gas pipe 14, which passes through plug 12 along with vent pipe 18 and drainage pipe 16, and displaces oxygen containing air out of vent pipe 18 by forcing the air downward towards the collection area of vent pipe 18. Again, the vented gases are monitored until oxygen is no longer detected, and then the vent pipe is sealed and a positive pressure placed within mine cavity 10. Drainage water is pumped out of the mine cavity through drainage pipe 16 and monitored until neutrality is observed. After neutrality is observed, the mine is permitted to flood with water and is permanently sealed.

The nature of the blanketing gas can be carbon dioxide, nitrogen, or ammonia. Carbon dioxide and nitrogen are non-reactive gases intended to displace oxygen and prevent the acid-causing reactions. Ammonia may also be used for such a purpose, but ammonia reacts with water to form a caustic.

$$NH_3+H_2O \rightarrow NH_4OH+H_2SO_4 \rightarrow (NH_4)_2SO_4+2\text{-}H_2O$$

This can be used to neutralize existing acid formation and inhibit *T. ferrooxidans* bacteria. Ammonia may be utilized as a pretreatment, followed by carbon dioxide or nitrogen, or mixed with carbon dioxide or nitrogen, as part of the blanketing gas. It can also be used as a blanket gas if desired.

Carbon dioxide can be used as either a pure gas or can be produced by burning fuel and using the flue gas as the blanket gas. Flue gas would, of course, consist primarily of carbon dioxide, nitrogen, and carbon monoxide, which would serve the same purpose as pure carbon dioxide.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of sealing a mine cavity comprising the steps of:

substantially closing off access to said mine cavity;

placing inert gas charging means in the mine cavity for charging said mine cavity with inert gas;

placing displaced gas vent and monitoring means in the mine cavity for venting free oxygen containing gases which are displaced from said mine cavity and monitoring the free oxygen content thereof, placing residual mine water discharge and monitoring means in the mine cavity for discharging and monitoring the chemical content of residual water exiting the mine cavity, flooding said mine cavity with inert gas under slight positive pressure so as to displace said free oxygen containing gases from said mine cavity;

monitoring the free oxygen content of said displaced gas until said content is substantially zero;

sealing the remaining inert gases within the mine cavity under slight positive pressure;

monitoring said discharging mine water until neutrality is observed;

flooding said mine cavity with water until said cavity is sealed.

2. A method as claimed in claim 1 wherein said inert gas is carbon dioxide.

3. A method as claimed in claim 1 wherein said inert gas is nitrogen.

4. A method as claimed in claim 1 wherein said inert gas is ammonia.

5. A method as claimed in claim 1 wherein said inert gas is a combination of gases.

* * * * *